US008865961B2

(12) United States Patent
Nzengung

(10) Patent No.: US 8,865,961 B2
(45) Date of Patent: Oct. 21, 2014

(54) METHODS FOR DISSOLUTION AND INSTANT NEUTRALIZATION OF SOLID NITROCELLULOSE PROPELLANTS AND PLASTICIZED MILITARY MUNITIONS

(76) Inventor: Valentine Asongu Nzengung, Libum, GA (US)

( * ) Notice: Subject to any disclaimer, the term of this patent is extended or adjusted under 35 U.S.C. 154(b) by 280 days.

(21) Appl. No.: 13/547,303

(22) Filed: Jul. 12, 2012

(65) Prior Publication Data

US 2014/0206922 A1 Jul. 24, 2014

Related U.S. Application Data

(60) Provisional application No. 61/526,681, filed on Aug. 23, 2011.

(51) Int. Cl.

| | |
|---|---|
| ***A62D 3/36*** | (2007.01) |
| ***F42B 33/06*** | (2006.01) |
| *A62D 101/06* | (2007.01) |

(52) U.S. Cl.

CPC ..... *A62D 3/36* (2013.01); *A62D 2101/06* (2013.01); *F42B 33/06* (2013.01)

USPC ..... 588/318; 588/403

(58) Field of Classification Search

USPC ..... 588/403, 401, 318

See application file for complete search history.

(56) References Cited

U.S. PATENT DOCUMENTS 5,849,984 A 12/1998 Kim et al.

OTHER PUBLICATIONS

Byung J. Kim, et al., Anaerobic Digestion and Acid Hydrolysis of Nitrocellulose, US Army Corps of Engineers, CERL Technical Report 99/45, Apr. 1999.

Byung J. Kim, et al., Alkaline Hydrolysis/Biodegradation of Nitrocellulose Fines, US Army Corps of Engineers, CERL Technical Report 98/65, Aug. 1998.

Tsan-Liang Su and Christos Christodoulatos, Destruction of Nitrocellulose Using Alkaline Hydrolysis, Proceedings of the Tri-Service Environmental Technology Workshop, "Enhancing Readiness Through Environmental Quality Technology" Held in Hershey, PA on May 20-22, 1996.

*Primary Examiner* — Edward Johnson

(74) *Attorney, Agent, or Firm* — White-Welker & Welker, LLC; Matthew T. Welker, Esq.

(57) ABSTRACT

Nitrocellulose propellants and plasticized military munitions, equipment, or contaminated soil are placed in a suitable container. A first option consists of adding a strong base to plasticized munitions in a container or militarization/demilitarization equipment or soil containing plasticized munitions or nitrocellulose propellant; adding an organic solvent; and then adding water to mixture. Alternatively, a second option consists of adding organic co-solvent to plasticized munitions in a container or soil containing plasticized munitions or solid nitrocellulose propellant. A strong base is added to mixture and allowed to react. When the reaction stops or is completed, a sulfur based bulk reductant is added to degrade all nitro and amino compounds. The organic solvent is evaporated and recovered for reuse and water is added to the container to make up for the evaporated organic solvent. If pH is higher than 8.5, a suitable acid is added to drop the pH to near neutral.

26 Claims, 7 Drawing Sheets

Client Sample ID: M1PBC1

General Chemistry

Lot-Sample #...: G0K120465-001 Work Order #...: L90GW Matrix.....: WATER
Date Sampled...: 10/27/10 Date Received..: 10/29/10

| PARAMETER | RESULT | RL | UNITS | METHOD | PREPARATION-ANALYSIS DATE | PREP BATCH # |
|---|---|---|---|---|---|---|
| Nitrate as N | 36.3 B,Q | 50.0 | mg/L | MCAWW 300.0A | 11/15/10 | 0319430 |
| | | Dilution Factor: 1000 | | MDL.....: 22.0 | | |
| Nitrite as N | 254 Q | 50.0 | mg/L | MCAWW 300.0A | 11/15/10 | 0319429 |
| | | Dilution Factor: 1000 | | MDL.....: 16.0 | | |
| Nitrocellulose | ND G | 2000 | mg/L | TAL-SOP WS-WC-005 | 11/13-11/15/10 | 0317941 |
| | | Dilution Factor: 1000 | | MDL.....: 478 | | |
| Sulfate | 1090 Q | 1000 | mg/L | MCAWW 300.0A | 11/15/10 | 0319431 |
| | | Dilution Factor: 1000 | | MDL.....: 49.0 | | |
| Total Sulfide | 12.5 B,G | 50.0 | mg/L | MCAWW 376.2 | 11/17/10 | 0321215 |
| | | Dilution Factor: 1000 | | MDL.....: 8.0 | | |

NOTE(S):

RL Reporting Limit

B Estimated result. Result is less than RL.

Q Elevated reporting limit. The reporting limit is elevated due to high analyte levels.

G Elevated reporting limit. The reporting limit is elevated due to matrix interference.

Fig. 5

Client Sample ID: DBPRC1

General Chemistry

Lot-Sample #...: G0K120465-004 Work Order #...: L90G5 Matrix.....: WATER
Date Sampled...: 10/28/10 Date Received..: 10/29/10

| PARAMETER | RESULT | RL | UNITS | METHOD | PREPARATION-ANALYSIS DATE | PREP BATCH # |
|---|---|---|---|---|---|---|
| Nitrate as N | 309 Q | 50.0 | mg/L | MCAWW 300.0A | 11/15/10 | 0319430 |
| | | Dilution Factor: 1000 | | MDL.....: 22.0 | | |
| Nitrite as N | 1000 Q | 50.0 | mg/L | MCAWW 300.0A | 11/15/10 | 0319429 |
| | | Dilution Factor: 1000 | | MDL.....: 16.0 | | |
| Nitrocellulose | ND G | 2000 | mg/L | TAL-SOP WS-WC-005 | 11/13-11/15/10 | 0317041 |
| | | Dilution Factor: 1000 | | MDL.....: 475 | | |
| Sulfate | ND G | 1000 | mg/L | MCAWW 300.0A | 11/15/10 | 0319431 |
| | | Dilution Factor: 1000 | | MDL.....: 49.0 | | |
| Total Sulfide | 18.6 B,G | 50.0 | mg/L | MCAWW 376.2 | 11/17/10 | 0321215 |
| | | Dilution Factor: 1000 | | MDL.....: 8.8 | | |

NOTE(S):

RL Reporting Limit

Q Elevated reporting limit. The reporting limit is elevated due to high analyte levels.

G Elevated reporting limit. The reporting limit is elevated due to matrix interference.

B Estimated result. Result is less than RL.

Fig. 6

| SPP | Glycosyl residue | Mass (μg) | Mol %[1] |
|---|---|---|---|
| | Arabinose (Ara) | 19.2 | 15.5 |
| | Rhamnose (Rha) | 0.0 | 0.0 |
| | Fucose (Fuc) | 0.0 | 0.0 |
| | Xylose (Xyl) | 9.1 | 7.4 |
| | Mannose (Man) | 43.5 | 29.1 |
| | Galactose (Gal) | 0.0 | 0.0 |
| | Glucose (Glc) | 71.8 | 48.1 |
| | Sum | 143.7 | 100.1 |

Fig. 7

VN012912 AA with hydrolysis report (both Figs)

| LS | Glycosyl residue | Mass (μg) | Mol %[1] |
|---|---|---|---|
| | Arabinose (Ara) | 16.7 | 13.2 |
| | Rhamnose (Rha) | 0.0 | 0.0 |
| | Fucose (Fuc) | 0.0 | 0.0 |
| | Xylose (Xyl) | 6.9 | 5.5 |
| | Mannose (Man) | 49.8 | 32.7 |
| | Galactose (Gal) | 0.8 | 0.5 |
| | Glucose (Glc) | 73.1 | 48.1 |
| | Sum | 147.3 | 100.0 |

Fig. 8

| | | | |
|---|---|---|---|
| | Mannose (Man) | 0.0 | - |
| | Glucose (Glc) | 0.2 | 100.0 |
| | Σ= | 0.2 | |

| LS | Glycosyl residue | Mass (μg) | Mol %[1] |
|---|---|---|---|
| | Mannose (Man) | 0.0 | - |
| | Glucose (Glc) | 0.3 | 100.0 |
| | Σ= | 0.3 | |

Fig. 9

VN012912 (AA) 4-UGA no hydrolysis

METHODS FOR DISSOLUTION AND INSTANT NEUTRALIZATION OF SOLID NITROCELLULOSE PROPELLANTS AND PLASTICIZED MILITARY MUNITIONS

CROSS REFERENCE TO RELATED APPLICATIONS

This application claims priority from U.S. Patent Application Ser. No. 61/526,681, entitled "Methods for Dissolution and Instant Neutralization of Nitrocellulose Propellants and Plasticized Military Munitions", filed on 23 Aug. 2011. The benefit under 35 USC §119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to the neutralization of military munitions. More specifically, the present invention relates to the technical field of dissolving and neutralizing solid nitrocellulose propellants and plasticized military munitions.

BACKGROUND OF THE INVENTION

Currently there are no methods to safely dispose of solid nitrocellulose propellants and plasticized military munitions except by blowing them up or burning them. Both of these practices are inherently dangerous, result in toxic byproducts and require the materials to be moved to safe location and stored until ready to dispose of.

Non-thermal methods exist for hydrolysis of Nitrocellulose (Acid Hydrolysis and Alkaline Hydrolysis, respectively). However, the prior art doesn't teach a method for hydrolysis of the pellets. The prior art does not teach or suggest a neutralization approach or process beyond the thermal destruction (burning or detonating) the solid nitrocellulose propellants and plasticized military munitions. Some processes break down the material but the end-products generally remain dangerous, toxic and potentially explosive.

Therefore, it is an objective of the present invention to teach a method for the dissolution and instant neutralization of solid (pellets) nitrocellulose propellants and plasticized military munitions.

SUMMARY OF THE INVENTION

The present invention is a step by step process for the dissolution and instant neutralization of solid nitrocellulose propellants and plasticized military munitions. By following the process and method taught by the present invention, the energetics will be dissolved and their explosive hazard removed. The advantages of the present invention include, without limitation, a safer, less expensive, more environmentally friendly and faster process and solution than current methods.

Currently there are no environmentally sustainable methods of safely disposing of solid nitrocellulose propellants and plasticized military munitions except by blowing them up (detonating) or burning them. Both of these practices are inherently dangerous, result in toxic byproducts and require the materials to be moved to safe location and stored until they are required to be disposed of. The process of the present invention can treat the solid nitrocellulose propellants and plasticized military munitions safely and quickly without having to transport the material to safe location for burning or explosive destruction. The process of the present invention is also much less expensive than current methods.

Solid nitrocellulose propellants and plasticized military munitions or the contaminated soil or equipment are placed in a suitable container. A first option consists of: adding a strong base to plasticized munitions in a container or soil containing plasticized munitions or solid nitrocellulose propellant (smokeless powder), adding an organic solvent and then adding water to mixture. Alternatively, a second option consists of: adding organic co-solvent to plasticized munitions or solid nitrocellulose propellant in a container or soil containing plasticized munitions or nitrocellulose propellant and then adding a strong base. The mixture is allowed to react. When reaction stops or is completed, a sulfur based bulk reductant is added to degrade all remaining nitro and amino compounds. The organic solvent is evaporated and recovered for reuse and water is added to the container to make up for the evaporated organic solvent. If the pH is higher than 8.5, a suitable acid is added to drop the pH to near neutral.

Furthermore the resulting solution will not be toxic or hazardous and can be disposed of as waste water in a publicly owned water treatment system (POWTS); the resulting soil will not be toxic or hazardous and can be disposed of as a non-hazardous waste; the decontaminated equipment will attain material determined as safe (MDAS) criteria. This process can treat the nitrocellulose propellants and plasticized military munitions safely without having to transport the material to safe location for burning or detonation.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

FIG. 5 illustrates the analytical results using the method of the present invention on single based propellant pellets;

FIG. 6 illustrates the analytical results using the method of the present invention on double base propellant pellets;

FIGS. 7 and 8 illustrates the analytical results using the method of the present invention on double base propellant pellets with hydrolysis report; and FIG. 9 illustrates the analytical results using the method of the present invention on double base propellant pellets with a 4-UGA no hydrolysis report.

DEFINITIONS

Figure 1:
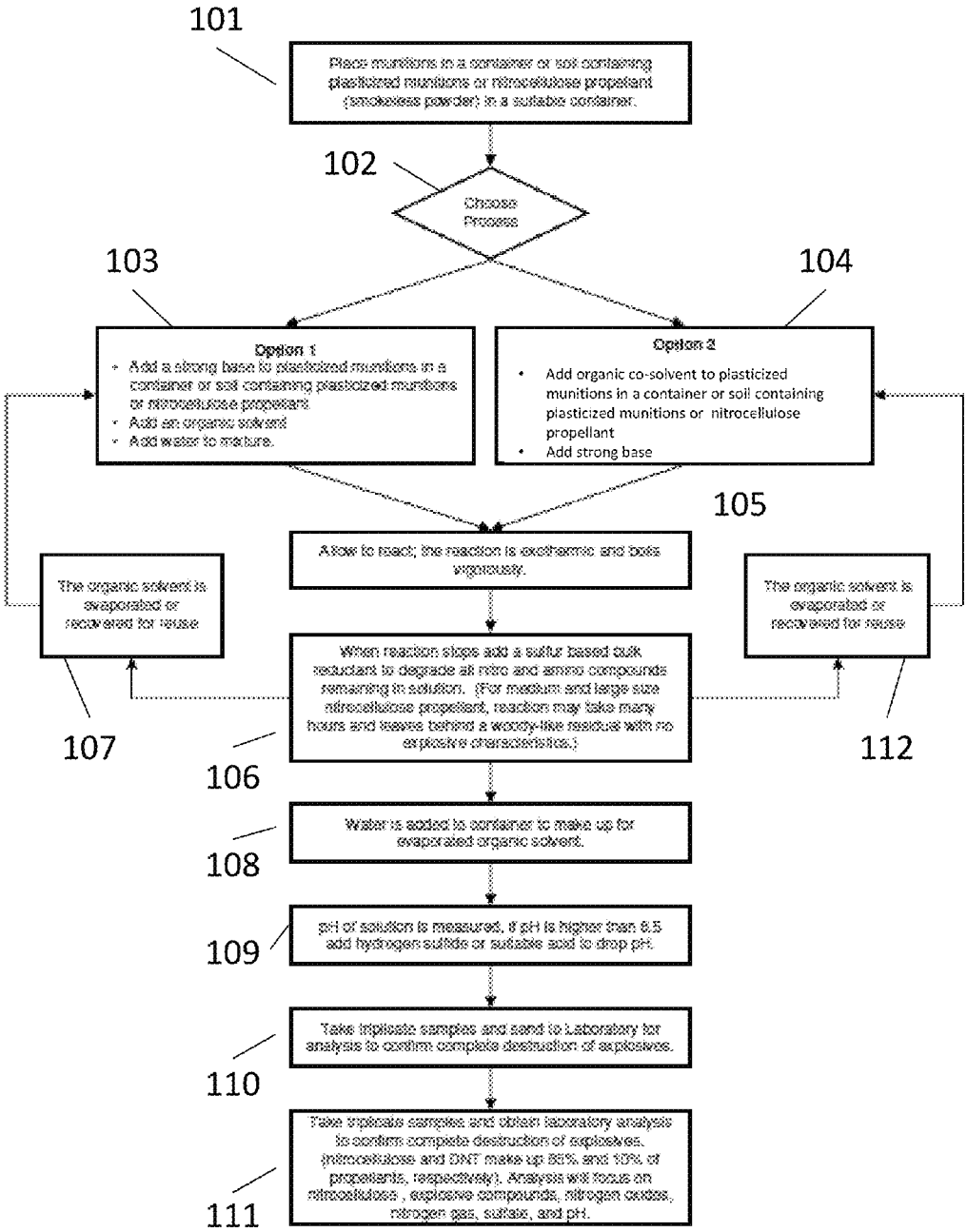
FIG. 1 is a process flow diagram of the methods for dissolution and instant neutralization of solid nitrocellulose propellants and plasticized military munitions, remediation of the contaminated soil and decontamination of equipment (i.e., nitrocellulose militarization/demilitarization equipment) as taught by the present invention.

Single Base Propellant: A single base propellants contains nitro cellulose as their chief ingredient. Single-base compositions are used as low-pressure propellants, such as those used in small arms ammunition. They may contain a stabilizer, inorganic nitrates, nitrocompounds, metallic salts, metals, carbohydrates and dyes.

Double Base Propellant: A double base propellants contains nitrocellulose and a liquid organic nitrate, such as nitroglycerine. As with single base, stabilizers and additives may be present. Double base propellants are used in cannon, small arms, mortars, rockets, and jet propulsion units.

Composite Propellant: Composite propellants do not contain nitrocellulose or organic nitrate. They contain a physical mixture of organic fuel (such as ammonium picrate), an inorganic oxidizing agent (such as potassium nitrate), and an organic binding agent. Composite propellants are used in rocket assemblies and jet propulsion units.

NC is the abbreviation for "Nitrocellulose".

NG is the abbreviation for "Nitroglycerine".

DNT is the abbreviation for "Dinitrotoluene"

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

The present invention is a step by step process for the dissolution and instant neutralization of solid nitrocellulose propellants and plasticized military munitions. By following the process and method taught by the present invention, the energetics will be dissolved and rendered no longer hazardous. The method of the present invention applies to dissolution and neutralization of solid nitrocellulose propellant of various particle sizes at ambient and elevated temperatures (10 degree Celsius to 100 degree Celsius) and applies to dissolution and neutralization of plasticized explosives of various particle sizes at and elevated temperatures (10 degree Celsius to 100 degree Celsius). Additionally, nitrocellulose propellant dissolved and hydrolyzed as described by the present invention and the resulting monosaccharide (e.g., fructose, glucose) may be converted to biofuel (e.g., ethanol) using existing fermentation and abiotic processes as practiced in the biofuel industry. The Reaction details/chemical equation of reductant is: Na2S2O4, H2S, FeS (i.e., iron sulfide=ferrous sulfide).

Referring to the invention, FIG. 1 shows a process to dissolve and instantly neutralize nitrocellulose propellants and plasticized military munitions as taught by the present invention. In step 101, munitions are placed in a container or soil containing plasticized munitions or nitrocellulose propellant (smokeless powder) is placed in a suitable container.

In step 102, a choice between one of two process options is selected. The first option 103 consists of the steps of: adding a strong base to plasticized munitions in a container or soil containing plasticized munitions or nitrocellulose propellant (smokeless powder), adding an organic solvent such as water miscible organic solvents, including: dimethyl sulfoxide (DMSO), dioxane, acetone and alcohols (e.g., ethanol, isopropyl alcohol, methanol) or mixture thereof, and then adding water at ambient or elevated temperatures to mixture. Water temperature may vary from 10 degree Celsius to 100 degree Celsius. This is especially important in winter and cold climates. In a preferred mode, the water temperature would be from 50 degree Celsius to 100 degree Celsius.

Alternatively, a second option 104 may be selected that consists of the steps of: adding organic co-solvent and strong base to plasticized munitions in a container or soil containing plasticized munitions or solid nitrocellulose propellant. Organic Co-solvents used in the second option 104 are binary and mixed solvents consisting of water and organic solvent (s). Inclusive is aqueous solution of strong bases with organic solvent and similar. Embodiment of water or an aqueous solution plus one or more organic solvents in the same solution.

After selecting either the first option 103 or the second option 104, the mixture is allowed to react in step 105; the reaction is exothermic and boils vigorously in the presence of a strong base and high concentration of nitrocellulose. Strong bases consisting of sodium hydroxide, calcium hydroxide, calcium oxide, magnesium hydroxide, and potassium hydroxide.

When the reaction stops or is completed, a sulfur based bulk reductant or sodium hydrosulfite (dithionite) (commonly known by its trademark/trade name "MUNIREM") is added to the mixture to degrade all nitro and amino compounds remaining in solution in step 106. For medium and large size NC (nitrocellulose) propellant, reaction may take many hours and leaves behind a woody-like residual with no explosive characteristics.

The use of bulk reductant such as hydrosulfite (dithionite) may not be necessary in some applications. For example when the product for the hydrolyzed nitrocellulose will be used for ethanol fuel production or glucose and fructose source or if the dissolved and neutralized nitrocellulose propellant will be treated by other methods (in a reactive column, in an adsorption column, treated in a wastewater plant) prior to disposal of the solution as a non-hazardous waste.

In step 107 or 112, the organic solvent, as determined by either following the first option 103 or the second option 104 is evaporated and recovered for reuse.

Next in step 108, water is added to the container to make up for the evaporated organic solvent. In step 109, the pH of solution is measured, if the pH is higher than 8.5 hydrogen sulfide or a suitable acid such as hydrogen sulfide, acetic acid, citric acid, formic acid, glycolic acid, or a similar acid is added to drop the pH to near neutral.

Triplicate samples are taken and sent to a laboratory for analysis to confirm complete destruction of explosives in step 110. NC makes up 85% or propellants while DNT makes up 10% of propellants. The analysis, as shown in FIGS. 5 and 6, focuses on NC, explosive compounds, nitrogen oxides, sulfate, and pH. The analysis focuses on nitrocellulose, explosive compounds, nitrogen oxides, nitrogen gas, sulfate, and pH. By following this process the energetics will be dissolved and no longer pose an explosive hazard. Furthermore, the resulting material will not be toxic or hazardous and can be disposed of as waste water at a POWTS.

Figure 2:
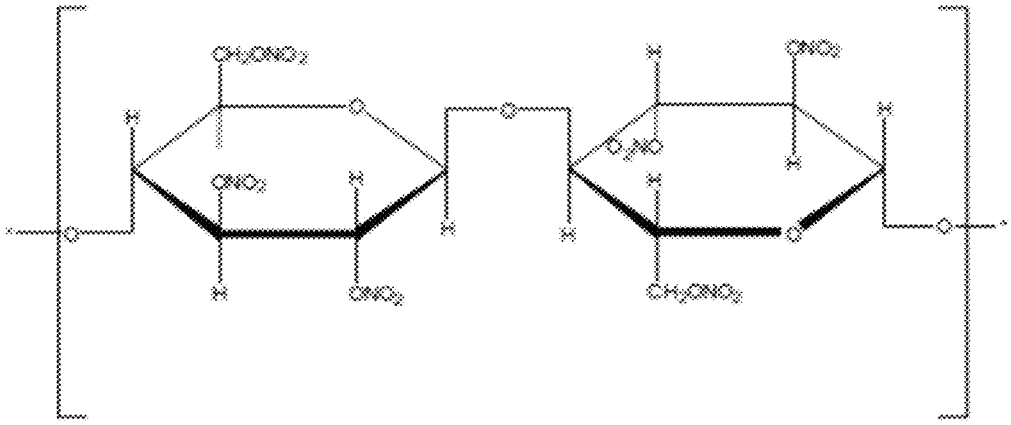
FIG. 2 is the chemical compound for fully nitrated nitrocellulose.
Figure 3:
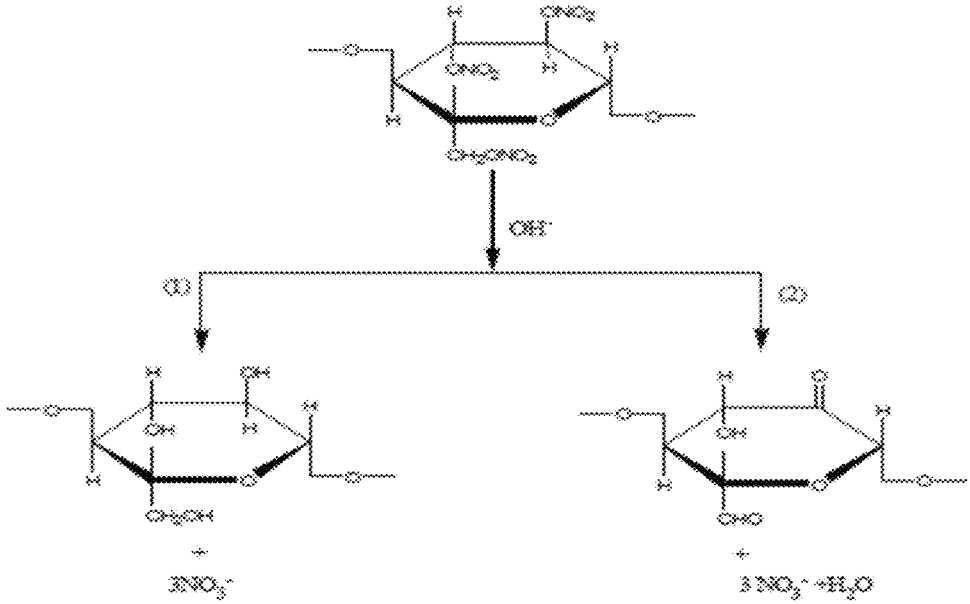
FIG. 3 illustrates the possible mechanisms of alkaline hydrolysis of dissolved nitrocellulose propellant pellets.
Figure 4:
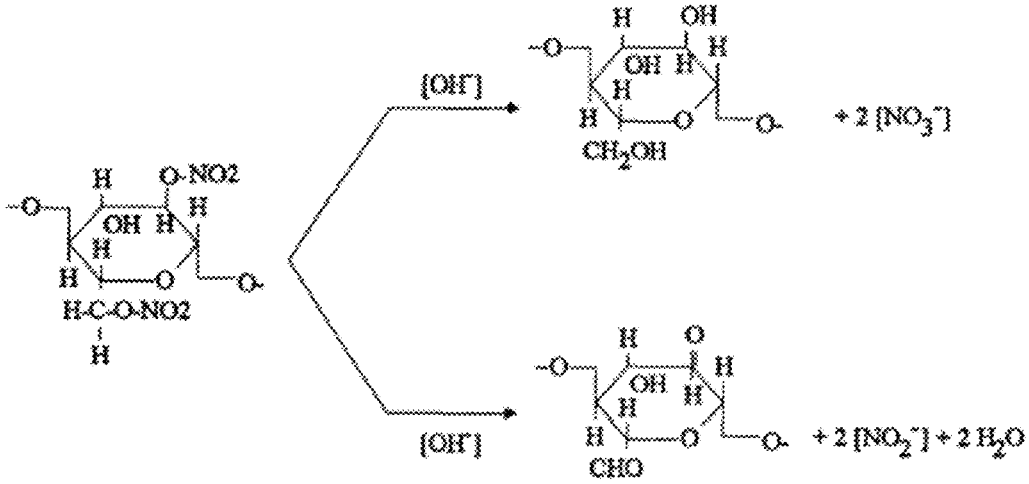
FIG. 4 illustrates the possible mechanisms of alkaline hydrolysis of dissolved nitrocellulose propellant pellets.

FIG. 2 is the chemical compound for fully nitrated nitrocellulose. FIGS. 3 and 4 illustrate the possible mechanisms of alkaline hydrolysis of dissolved nitrocellulose propellant pellets as adapted from literature before schematics can be created.

Now referring to FIGS. 7-8, about 20 ul of the samples were placed into separate test tubes. 20 ug of inositol was added to the samples as an internal standard and the tubes were lyophilized. The samples were hydrolyzed using 2 M trifluoroacetic acid (2 h in sealed tube at 121° C.), reduced with NaBD4, and acetylated using acetic anhydride/trifluoroacetic acid. The resulting derivatives were analyzed on a Hewlett Packard 5975C GC interfaced to a 7890A MSD (mass selective detector, electron impact ionization mode); separation was performed on a 30 m Supelco 2330 bonded phase fused silica capillary column. (Same procedures with standard AA).

The major sugars detected were glucose, and mannose in most of the samples. Other sugars like arabinose and xylose were found in a minor quantity in most of the sample. Fructose was not detected in any of the sample. There were lots of unusual peaks in the sample and the spectra for those peaks was determined and confirmed that the unusual peaks represent yet to be identified organic anions not identified in the starting material (dissolved NC propellant). Arabinose and xylose sugar were found at the same retention as that of standard with a unit mass change like isotopic element of these sugars.

The analysis reported above does NOT include the absolute configuration (D or L) of monosaccharides. The absolute configuration of monosaccharides will be determined with additional experiments.

Now referring to FIG. 9, about 20 ul of the samples were placed into separate test tubes. 20 ug of inositol was added to the samples as an internal standard and the tubes were lyophilized. The samples were reduced with NaBD4, and acetylated using acetic anhydride/trifluoroacetic acid. The resulting derivatives were analyzed on a Hewlett Packard 5975C GC interfaced to a 7890A MSD (mass selective detector, electron impact ionization mode); separation was performed on a 30 m Supelco 2330 bonded phase fused silica capillary column.

There were limited amounts of sugars in the samples. No Fucose, Arabinose, Galactose, Xylose, and rhamnose was detected. Only glucose was detected, but the amount was very minor. This result shows that there are no free residues in the sample.

The results of the above analysis illustrates that the byproduct of sugar from the method taught by the present invention is an unexpected result. Therefore the results show that the claimed invention exhibits some superior property or advantage that a person of ordinary skill in the relevant art would have found surprising or unexpected.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A method for the dissolution and neutralization of nitrocellulose propellants and plasticized military munitions comprising the steps of:

placing plasticized munitions or nitrocellulose propellant or equipment or soil containing plasticized munitions or nitrocellulose propellant in a container;

selecting from one of two reaction options:

the first option consists of the steps of:

adding a strong base to plasticized munitions in the container or soil containing plasticized munitions or solid nitrocellulose propellant, adding an organic solvent, and adding water to mixture, the second option consists of the steps of:

adding organic co-solvent to plasticized munitions in a container or soil containing plasticized munitions or solid nitrocellulose propellant;

allowing the mixture to react;

adding a sulfur based bulk reductant to the mixture to degrade all nitro and amino compounds remaining in solution;

evaporating and recovering the organic solvent, as determined by either following the first option or the second option for reuse;

adding to the container to make up for the evaporated organic solvent;

measuring the pH of solution; and adding a suitable acid if the pH is higher than 8.5 to drop the pH to near neutral.

2. The method of claim 1, wherein the water temperature range is 10 degree Celsius to 100 degrees Celsius.

3. The method of claim 2, wherein the water temperature range is 50 degree Celsius to 100 degrees Celsius.

4. The method of claim 1, wherein the organic solvent of the first reaction is water miscible organic solvents, including: dimethyl sulfide, acetone and alcohols.

5. The method of claim 4, wherein the alcohols are selected from a group consisting of: ethanol, isopropyl alcohol, and methanol.

6. The method of claim 1, wherein the organic co-solvents used in the second option is binary and mixed solvents consisting of water and organic solvent.

7. The method of claim 6, wherein the co-solvent is an aqueous solution of strong bases with organic solvent and similar.

8. The method of claim 6, wherein the co-solvent is water or an aqueous solution plus one or more organic solvents in the same solution.

9. The method of claim 1, wherein the strong bases consist of sodium hydroxide, calcium hydroxide, calcium oxide, magnesium hydroxide, potassium hydroxide, or a mixture thereof.

10. The method of claim 1, wherein the sulfur based bulk reductant is replaced with hydrogen sulfide, FeS, zero-valent iron, or a mixture of reduced iron and activated carbon.

11. The method of claim 1, wherein the suitable acid for dropping the pH is hydrogen sulfide, acetic acid, formic acid, citric acid, or glycolic acid.

12. A method for the dissolution and neutralization of solid nitrocellulose propellants and plasticized military munitions comprising the steps of:

placing plasticized munitions or solid nitrocellulose propellant or soil containing plasticized munitions or nitrocellulose propellant in a container;

adding a strong base to plasticized munitions in the container or soil containing plasticized munitions or solid nitrocellulose propellant, adding an organic solvent;

adding water to mixture;

allowing the mixture to react;

adding a sulfur based bulk reductant to the mixture to degrade all nitro and amino compounds remaining in solution;

evaporating and recovering the organic solvent, as determined by either following the first option or the second option for reuse;

adding to the container to make up for the evaporated organic solvent;

measuring the pH of solution; and adding a suitable acid if the pH is higher than 8.5 to drop the pH to near neutral.

13. The method of claim 12, wherein the organic solvent of the first reaction is water miscible organic solvents, including: acetone and alcohols.

14. The method of claim 13, wherein the alcohols are selected from a group consisting of: ethanol, isopropyl alcohol, and methanol.

15. The method of claim 13, wherein the strong bases consist of sodium hydroxide, calcium hydroxide, calcium oxide, magnesium hydroxide, and potassium hydroxide.

16. The method of claim 13, wherein the temperature range is 10 degree Celsius to 100 degrees Celsius.

17. The method of claim 16, wherein the temperature range is 50 degree Celsius to 100 degrees Celsius.

18. The method of claim 13, wherein the sulfur based bulk reductant is replaced with hydrogen sulfide, FeS, zero-valent iron, or a mixture of reduced iron and activated carbon.

19. The method of claim 13, wherein the suitable acid for dropping the pH is hydrogen sulfide, acetic acid, formic acid, citric acid, or glycolic acid.

20. A method for the dissolution and neutralization of nitrocellulose propellants and plasticized military munitions comprising the steps of:

placing plasticized munitions or nitrocellulose propellant or soil containing plasticized munitions or nitrocellulose propellant in a container;

adding organic co-solvent to plasticized munitions in a container or soil containing plasticized munitions or nitrocellulose propellant;

allowing the mixture to react;

adding a sulfur based bulk reductant to the mixture to degrade all nitro and amino compounds remaining in solution;

evaporating and recovering the organic solvent, as determined by either following the first option or the second option for reuse;

adding to the container to make up for the evaporated organic solvent;

measuring the pH of solution; and adding a suitable acid if the pH is higher than 8.5 to drop the pH to near neutral.

21. The method of claim 20, wherein the organic co-solvents is binary and mixed solvents consisting of water and organic solvent.

22. The method of claim 21, wherein the co-solvent is an aqueous solution of strong bases with organic solvent and similar.

23. The method of claim 21, wherein the co-solvent is water or an aqueous solution plus one or more organic solvents in the same solution.

24. The method of claim 21, wherein the sulfur based bulk reductant is replaced with hydrogen sulfide, FeS, zero-valent iron, or a mixture of reduced iron and activated carbon.

25. The method of claim 21, wherein the suitable acid for dropping the pH is hydrogen sulfide, acetic acid, formic acid, citric acid, or glycolic acid.

26. The method of claim 21, wherein the nitrocellulose propellant dissolved and hydrolyzed as described produces a monosaccharide used for production of biofuel.

* * * * *